United States Patent [19]

Parry

[11] Patent Number: 4,510,872

[45] Date of Patent: Apr. 16, 1985

[54] DRAFTING EQUIPMENT HOLDER

[76] Inventor: James L. Parry, 1730 Byron, Madison Heights, Mich. 48071

[21] Appl. No.: 398,689

[22] Filed: Jul. 15, 1982

[51] Int. Cl.[3] ..... A47B 85/00

[52] U.S. Cl. ..... 108/25; 211/50; 248/340

[58] Field of Search ..... 108/25, 26, 33, 34, 108/38; 312/328; 297/153, 135; 211/113, 50, 88, 184, 10, 11, 86; 248/364, 215, 340, 318; 160/349 R

[56] References Cited

U.S. PATENT DOCUMENTS

| | | | |
|---|---|---|---|
| 907,706 | 12/1908 | Seavey | 248/340 |
| 1,938,025 | 12/1933 | Kelly | 211/50 X |
| 2,922,567 | 1/1960 | McDermott | 211/50 X |
| 3,282,328 | 11/1966 | Mushro et al. | 160/349 R |
| 3,759,569 | 9/1973 | Bennet | 108/25 X |
| 3,854,242 | 12/1974 | Gladstein | 248/318 X |
| 3,952,985 | 4/1976 | Davenport | 248/340 X |
| 4,231,175 | 11/1980 | Baxter | 211/51 X |
| 4,373,639 | 2/1983 | Tricon | 211/86 |

FOREIGN PATENT DOCUMENTS

| | | | |
|---|---|---|---|
| 1216359 | 11/1959 | France | 108/64 |

*Primary Examiner*—William E. Lyddane
*Assistant Examiner*—Peter A. Aschenbrenner
*Attorney, Agent, or Firm*—Harry R. Dumont

[57] ABSTRACT

A holder for templates, triangles and the like that is slidably mounted on a drawing board eraser trough to permit its ready movement along the length of the drawing board. The holder includes several compartments with differing height dividers therebetween and further has a bottom slanted forwardly to permit lay-back of the templates or other equipment in a readily accessible position.

2 Claims, 3 Drawing Figures

DRAFTING EQUIPMENT HOLDER

BACKGROUND OF THE INVENTION

A problem arises in the handling of templates and in maintaining them in a convenient and accessible position without placing them on the surface of the drafting work so as to obscure or to impede the drawing. Drafting equipment receptacles are known and one type of these is shown in U.S. Pat. No. 3,095,835 issued to S. M. Smith on July 2, 1963 for "DRAFTING EQUIPMENT RECEPTACLE". The present invention relates to an improvement of that receptacle which is attached in a stationary manner to the drafting board and further does not incorporate dividers and compartments of the type used in the present invention that maintain the different size templates separated and available for convenient use. Other tray attachments of various types are known in the prior art for attachment to tables and one such arrangement is shown in U.S. Pat. No. 2,707,141 issued on Apr. 26, 1955 to L. L. Witter for "TRAY ATTACHMENT FOR FOLDING GAME TABLE TOP". This patent again does not show a holder adapted to hold different sized templates in different partitioned compartments for ready use and is not particularly adapted to a drafting table use.

BRIEF SUMMARY OF THE INVENTION

The present invention will be seen to include a novel and improved holder for templates that is slidably mounted on a drafting table eraser trough by a pair of overlapping S-shaped brackets that freely slide along the length of the eraser trough to the position desired by the draftsman. The holder itself includes tape holders on each side and different height partitions forming separate readily accessible open compartments for storage of the templates. Layback of the templates in a stable position is assured by provision of a forward slanting floor in the holder bottom.

BRIEF DESCRIPTION OF THE DRAWINGS

The present invention will now be explained in conjunction with the accompanying specification and in the drawings in which like numerals are used to refer to like parts and in which.

DETAILED DESCRIPTION OF THE PREFERRED EMBODIMENT

Figure 1:
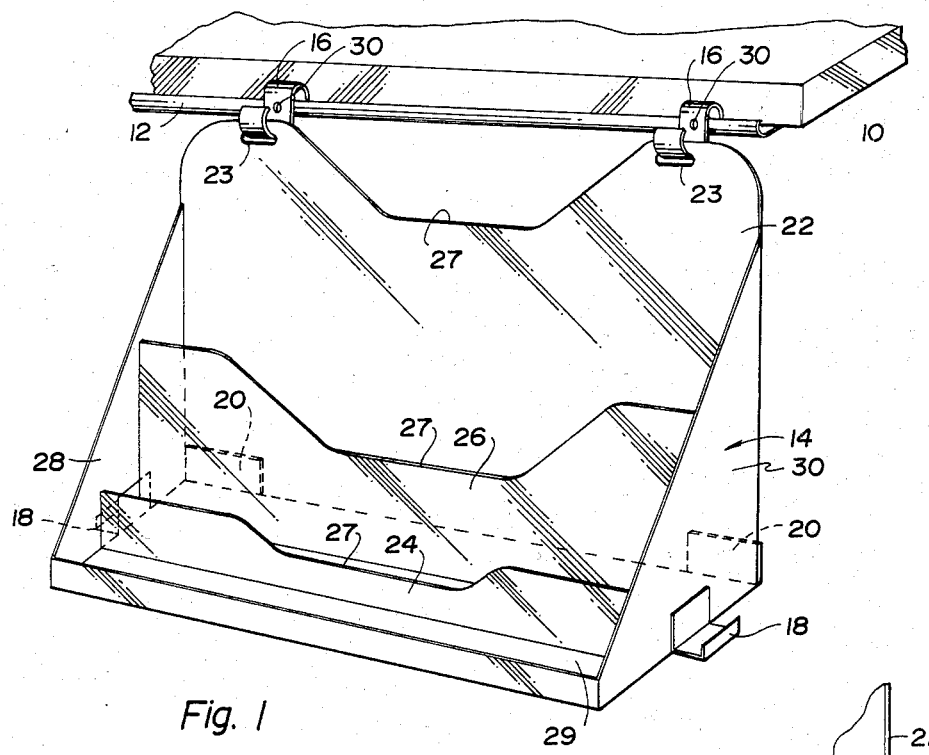
FIG. 1 is a perspective view of the template holder in its mounted position.

FIG. 1 shows the drawing table 10 having a forwardly positioned eraser or pencil trough 12 that is firmly attached to the under surface of the drawing board 10. The template holder 14 is slidably mounted over the eraser trough 12 by a pair of upwardly and downwardly bent hook ends 16. The holder 14 includes at each side a laterally extending tape holder 18 for further conveniently arranging the tape rolls for the draftsman. A pair of weights 20 are fixed to the rear wall 22 of the holder 14. The weights maintain the holder in a vertical position and keep it level with respect to the board. A pair of dividers 24 and 26 are fixed and spaced one from the other between sides 28 and 30. They may be attached in their vertical position by gluing or fasteners or other means.

It will also be seen that the rear wall 22 of the holder 14 has a shape complementary to the shape of the dividers 24 and 26, each having central cutout portions 27 as shown which facilitate reaching and grasping the desired tool for use.

Figure 2:
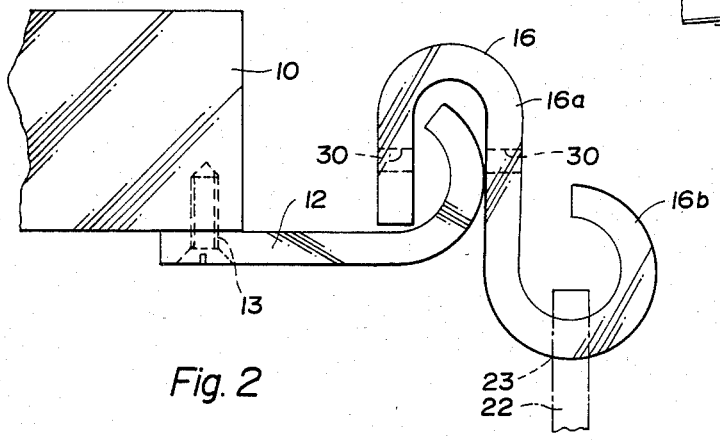
FIG. 2 is a cross-sectional view with parts broken away further showing the detail of the mounting means for the holder.

FIG. 2 shows the manner in which the eraser trough 12 is attached at the forward end of the drafting board 12 by a threaded fastener 13. Also the detail is shown of the hook mounting means 16 that are attached to hold the template holder over the eraser trough 12. Each hook 16 is of a generally S-shaped configuration with upward and lower bends **16*a* and 16*b* respectively. The upper bend portion 16*a* is looped over the eraser trough 12 while the lower looped portion 16*b* engages the rear wall 22 of the holder 14 through a slot 23** formed therein.

It will thus be seen that when desired the entire mounting means and holder 14 can be lifted and set aside either for shipment or for use when at another location.

FIG. 2 also shows an opening 30 formed through the upper loop **16*a* that can be used to receive a bolt or other fastener if it desirable to remove the holder 14 from the front of the drawing board 10 and mounted in another position for example on the side of the drawing board 10**.

Figure 3:
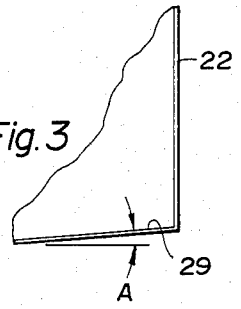
FIG. 3 is a fragmentary view showing the slant arrangement between the floor and the rearward vertical wall of the holder.

As shown in FIG. 3, the floor 29 of the holder is slanted forwardly and lies at an angle A of between 5 and 15 degrees to the horizontal. This insures that the template when placed in one of the compartments will lean backwardly in a uniform fashion to make it available for inspection and use. Each cutout portion 27 makes it easier for the draftsman to reach in and with his fingers remove the desired tool.

It will thus be seen that I have provided by my invention a novel and improved template holder for use in connection with drafting tables. It is versatile and extremely convenient in use and handling.

I claim:

1. A template holder for a plurality of templates for use in conjunction with a drafting table having a frontwardly oriented eraser trough, comprising;

a holder container including a back wall, a floor inclined to horizontal and slated frontwardly to provide a lean-over of all the templates in a like inclining direction and a pair of side walls;

a plurality of spaced dividers of increasing height front to back mounted intermediate said side walls substantially parallel to said back wall for providing separate open compartments for receiving and holding said inclined templates in place, each of said dividers having a liked shaped central cutout portion to facilitate the grasp of the articles carried therein; and a mounting means for slidably mounting said holder on the forward edge of said eraser trough, said mounting means comprising a pair of spaced s-shaped hooks each being open at both ends, the upper end of which overlaps said trough and the lower end of which extends through a mating slot formed in the rear wall of said holder.

2. The combination as set forth in claim 1 wherein a pair of tape roll holders are mounted at opposite sides of said holder.

* * * * *